US009869952B2

(12) United States Patent
Utsunomiya et al.

(10) Patent No.: US 9,869,952 B2
(45) Date of Patent: Jan. 16, 2018

(54) FIXING DEVICE AND IMAGE FORMING APPARATUS INCLUDING A FRICTION REDUCER INCLUDING A LUBRICANT

(71) Applicants: Kohichi Utsunomiya, Kanagawa (JP); Hideo Nagafuji, Kanagawa (JP); Arinobu Yoshiura, Miyagi (JP); Yutaka Ikebuchi, Kanagawa (JP); Motoyoshi Yamano, Kanagawa (JP)

(72) Inventors: Kohichi Utsunomiya, Kanagawa (JP); Hideo Nagafuji, Kanagawa (JP); Arinobu Yoshiura, Miyagi (JP); Yutaka Ikebuchi, Kanagawa (JP); Motoyoshi Yamano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/295,275

(22) Filed: Oct. 17, 2016

(65) Prior Publication Data

US 2017/0131664 A1 May 11, 2017

(30) Foreign Application Priority Data

Nov. 11, 2015 (JP) ..... 2015-221087
May 16, 2016 (JP) ..... 2016-098009

(51) Int. Cl.
*G03G 15/20* (2006.01)

(52) U.S. Cl.
CPC ..... *G03G 15/2025* (2013.01); *G03G 15/2053* (2013.01); *G03G 15/2075* (2013.01); *G03G 2215/2035* (2013.01)

(58) Field of Classification Search
CPC ..... G03G 15/2053; G03G 15/2075; G03G 15/2025; G03G 2215/2035; G03G 2215/2038
USPC ..... 399/329
See application file for complete search history.

(56) References Cited

U.S. PATENT DOCUMENTS 7,844,208 B2 * 11/2010 Hayashi ..... G03G 15/2025 399/329
8,737,895 B2 * 5/2014 Suzuki ..... G03G 15/2025 399/329
9,002,254 B2 * 4/2015 Ohtsu ..... G03G 15/2053 399/329

(Continued)

FOREIGN PATENT DOCUMENTS

JP 2004-325750 11/2004
JP 2006078965 A * 3/2006

(Continued)

*Primary Examiner* — Robert Beatty
(74) *Attorney, Agent, or Firm* — Oblon, McClelland, Maier & Neustadt, L.L.P.

(57) ABSTRACT

A fixing device includes a fixing rotator that is endless and rotatable in a rotation direction and a heater to heat the fixing rotator. A pressure rotator contacts an outer circumferential surface of the fixing rotator. A nip formation pad presses against the pressure rotator via the fixing rotator to form a fixing nip between the fixing rotator and the pressure rotator. The nip formation pad includes an upstream portion disposed upstream from the fixing nip in the rotation direction of the fixing rotator. A recess is disposed in the upstream portion of the nip formation pad. A friction reducer is sandwiched between the nip formation pad and the fixing rotator and bears a lubricant.

18 Claims, 8 Drawing Sheets

(56) References Cited

U.S. PATENT DOCUMENTS

2004/0151522 A1* 8/2004 Kato ..... G03G 15/2025 399/328
2007/0292175 A1 12/2007 Shinshi
2011/0052245 A1 3/2011 Shinshi et al.
2011/0058865 A1 3/2011 Tokuda et al.
2011/0058866 A1 3/2011 Ishii et al.
2011/0076071 A1 3/2011 Yamaguchi et al.
2011/0158716 A1* 6/2011 Fujiwara ..... G03G 15/2053 399/329
2012/0114345 A1 5/2012 Fujimoto et al.
2012/0121304 A1 5/2012 Tokuda et al.
2012/0155936 A1 6/2012 Yamaguchi et al.
2013/0170877 A1 7/2013 Yoshiura et al.
2013/0170879 A1 7/2013 Yoshinaga et al.
2013/0170880 A1 7/2013 Gotoh et al.
2013/0177340 A1 7/2013 Kawata et al.
2013/0183070 A1 7/2013 Kawata et al.
2013/0189007 A1* 7/2013 Ohtsu ..... G03G 15/206 399/329
2013/0189008 A1 7/2013 Ishii et al.
2013/0195523 A1 8/2013 Yamaji et al.
2013/0195524 A1 8/2013 Ishii et al.
2013/0236224 A1* 9/2013 Matsumoto ..... G03G 15/2053 399/329
2013/0266355 A1 10/2013 Yoshiura et al.
2014/0241766 A1 8/2014 Ishii et al.
2014/0369726 A1* 12/2014 Soeda ..... G03G 15/2053 399/329
2015/0023705 A1 1/2015 Kawata et al.
2015/0198919 A1* 7/2015 Lee ..... G03G 15/2075 399/329
2016/0223964 A1 8/2016 Ikebuchi et al.
2016/0274515 A1 9/2016 Imada et al.
2016/0274519 A1* 9/2016 Lim ..... G03G 15/2053

FOREIGN PATENT DOCUMENTS

JP 2007-233011 9/2007
JP 2007-334205 12/2007
JP 2014071212 A * 4/2014
JP 2014186315 A * 10/2014
JP 2015055825 A * 3/2015

* cited by examiner

FIXING DEVICE AND IMAGE FORMING APPARATUS INCLUDING A FRICTION REDUCER INCLUDING A LUBRICANT

CROSS-REFERENCE TO RELATED APPLICATIONS

This patent application is based on and claims priority pursuant to 35 U.S.C. §119 to Japanese Patent Application Nos. 2015-221087, filed on Nov. 11, 2015, and 2016-098009, filed on May 16, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator that is endless and rotatable in a rotation direction and a heater to heat the fixing rotator. A pressure rotator contacts an outer circumferential surface of the fixing rotator. A nip formation pad presses against the pressure rotator via the fixing rotator to form a fixing nip between the fixing rotator and the pressure rotator. The nip formation pad includes an upstream portion disposed upstream from the fixing nip in the rotation direction of the fixing rotator. A recess is disposed in the upstream portion of the nip formation pad. A friction reducer is sandwiched between the nip formation pad and the fixing rotator and bears a lubricant.

This specification further describes an improved fixing device. In one exemplary embodiment, the fixing device includes a fixing rotator that is endless and rotatable in a rotation direction and a heater to heat the fixing rotator. A pressure rotator contacts an outer circumferential surface of the fixing rotator. A nip formation pad presses against the pressure rotator via the fixing rotator to form a fixing nip between the fixing rotator and the pressure rotator. The nip formation pad includes a nip forming portion disposed opposite the fixing nip. An upstream portion is disposed upstream from the nip forming portion in the rotation direction of the fixing rotator. The upstream portion includes a recess disposed substantially at a center of the nip formation pad in a longitudinal direction of the nip formation pad. The recess is recessed toward the nip forming portion in the rotation direction of the fixing rotator. A friction reducer is sandwiched between the nip formation pad and the fixing rotator and bears a lubricant.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing rotator that is endless and rotatable in a rotation direction and a heater to heat the fixing rotator. A pressure rotator contacts an outer circumferential surface of the fixing rotator. A nip formation pad presses against the pressure rotator via the fixing rotator to form a fixing nip between the fixing rotator and the pressure rotator. The nip formation pad includes an upstream portion disposed upstream from the fixing nip in the rotation direction of the fixing rotator. A recess is disposed in the upstream portion of the nip formation pad. A friction reducer is sandwiched between the nip formation pad and the fixing rotator and bears a lubricant.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
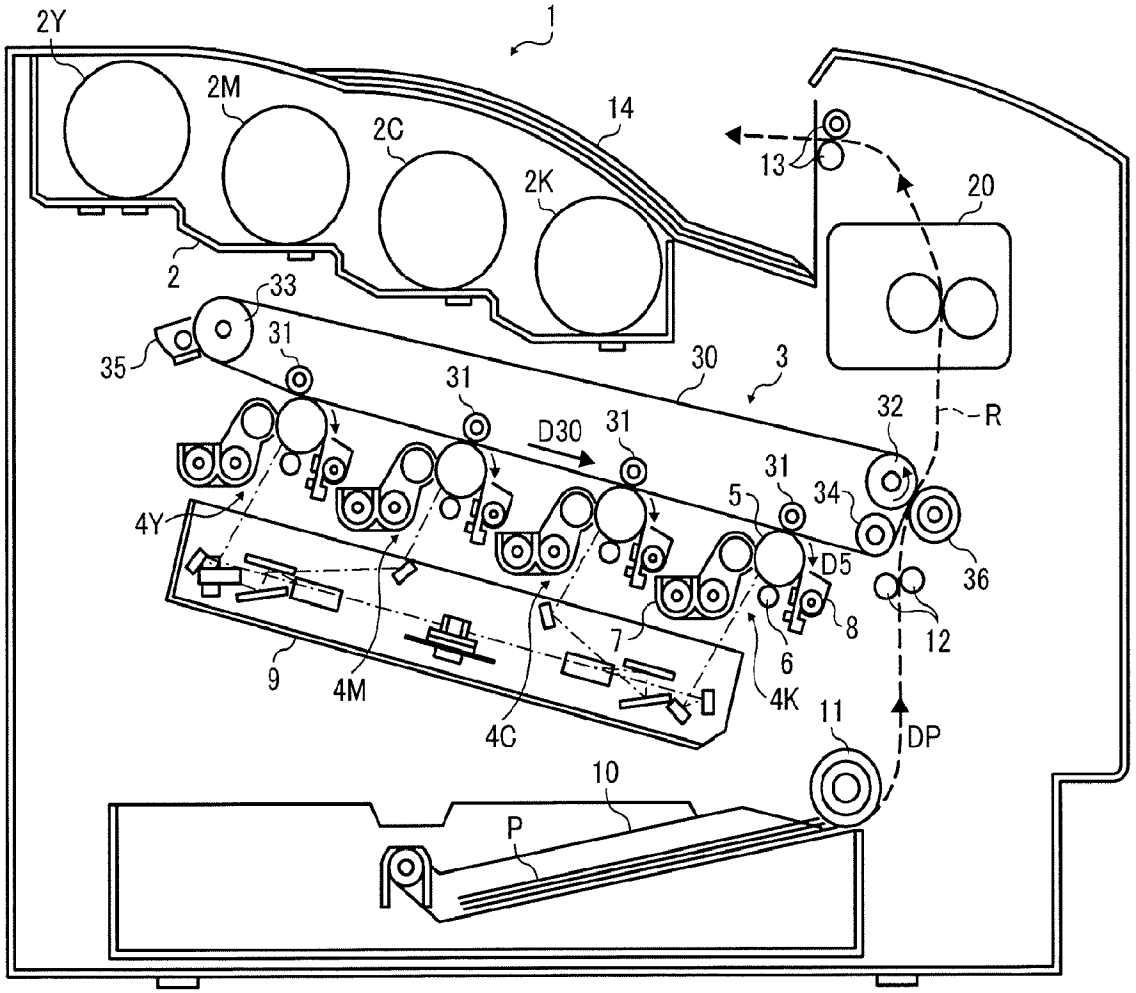
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 is a color laser printer incorporating four image forming devices 4Y, 4M, 4C, and 4K situated in a center portion of the image forming apparatus 1. Although the image forming devices 4Y, 4M, 4C, and 4K contain developers in different colors, that is, yellow, magenta, cyan, and black corresponding to color separation components of a color image (e.g., yellow, magenta, cyan, and black toners), respectively, the image forming devices 4Y, 4M, 4C, and 4K have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as a transferred image bearer, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies at least one of a predetermined direct current (DC) voltage and a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 located above the secondary transfer nip, that is, downstream from the secondary transfer nip in the sheet conveyance direction DP. The fixing device 20 fixes an unfixed toner image, which is transferred from the intermediate transfer belt 30, on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constructing color image data sent from the external device, respectively, thus forming electrostatic latent images thereon. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing a surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constructing the full color toner image formed on the intermediate transfer belt 30, thus creating a transfer electric field at the secondary transfer nip.

As the yellow, magenta, cyan, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. The sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor toner image or a tricolor toner image by using two or three of the image forming devices 4Y, 4M, 4C, and 4K.

A description is provided of a construction of the fixing device 20 according to a first exemplary embodiment, which is incorporated in the image forming apparatus 1 having the construction described above.

Figure 2:
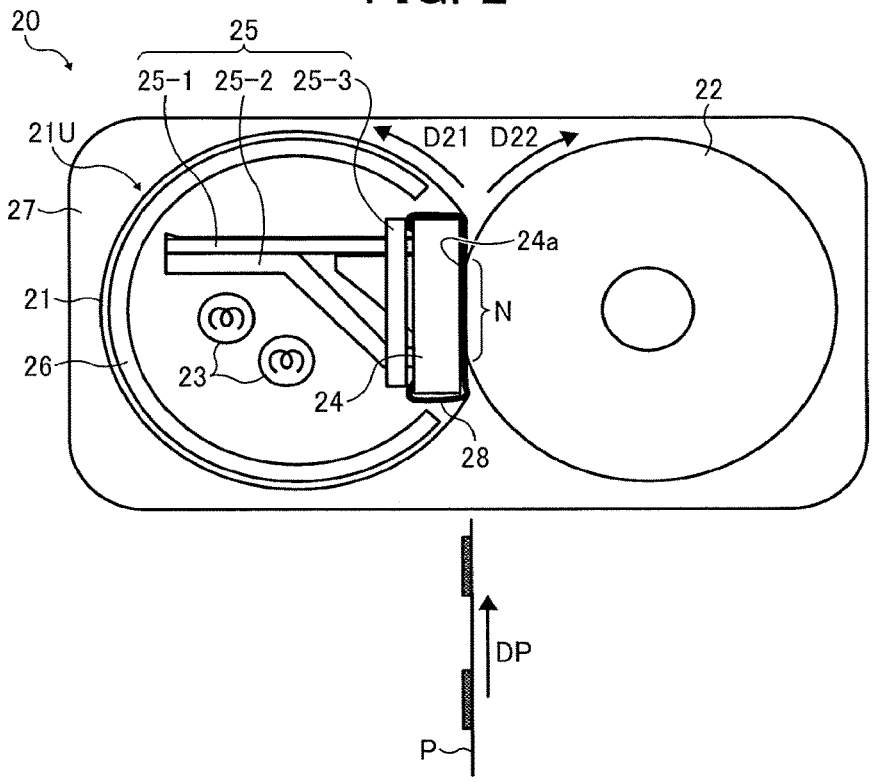
FIG. 2 is a vertical cross-sectional view of a fixing device according to a first exemplary embodiment of the present disclosure that is incorporated in the image forming apparatus depicted in FIG. 1.

FIG. 2 is a vertical cross-sectional view of the fixing device 20. As illustrated in FIG. 2, the fixing device 20 (e.g., a fuser or a fusing unit) includes a fixing belt 21 formed into a loop and serving as a fixing rotator or a fixing member rotatable in a rotation direction D21 and a pressure roller 22 serving as a pressure rotator disposed opposite the fixing belt 21 and rotatable in a rotation direction D22. A halogen heater 23 serving as a heater or a heat source is disposed inside the loop formed by the fixing belt 21. The halogen heater 23 emits heat or light that irradiates an inner circumferential surface of the fixing belt 21 directly, heating the fixing belt 21 with radiant heat or light. A nip formation pad 24 disposed inside the loop formed by the fixing belt 21 and disposed opposite the pressure roller 22 via the fixing belt 21 presses against the pressure roller 22 via the fixing belt 21 to form a fixing nip N between the fixing belt 21 and the pressure roller 22. A low-friction sheet 28 serving as a friction reducer or a low-friction member is sandwiched between the fixing belt 21 and the nip formation pad 24. As the fixing belt 21 rotates in the rotation direction D21, the inner circumferential surface of the fixing belt 21 slides over the nip formation pad 24 indirectly via the low-friction sheet 28. The fixing device 20 further includes a stay 25.

The fixing belt 21 and the components disposed inside the loop formed by the fixing belt 21, that is, the halogen heater 23, the nip formation pad 24, the stay 25, and the low-friction sheet 28, may construct a belt unit 21U separably coupled to the pressure roller 22. As a sheet P bearing an unfixed toner image is conveyed through the fixing nip N, the fixing belt 21 and the pressure roller 22 melt and fix the toner image on the sheet P under heat and pressure.

A detailed description is now given of a construction of the fixing belt 21.

The fixing belt 21 serving as a fixing rotator is a thin, flexible endless belt or film. A holder 26 is disposed opposite each lateral end of the fixing belt 21 in an axial direction thereof, which is substantially tubular, thus rotatably supporting the fixing belt 21.

A detailed description is now given of a construction of the pressure roller 22.

The pressure roller 22 serving as a pressure rotator is constructed of a cored bar, an elastic layer coating the cored bar, and a surface release layer coating the elastic layer. A pressurization assembly presses the pressure roller 22 against the nip formation pad 24 via the fixing belt 21. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction DP. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

A detailed description is now given of a configuration of the halogen heater 23.

The halogen heater 23 serves as a heater or a heat source that heats the fixing belt 21. Both lateral ends of the halogen heater 23 in a longitudinal direction thereof parallel to the axial direction of the fixing belt 21 are secured to side plates 27, respectively. A controller (e.g., a processor), that is, a central processing unit (CPU) provided with a random-access memory (RAM) and a read-only memory (ROM), for example, operatively connected to a temperature sensor and the halogen heater 23, controls the halogen heater 23 based on a temperature of the outer circumferential surface of the fixing belt 21 detected by the temperature sensor. Thus, the controller adjusts the temperature of the fixing belt 21 to a desired fixing temperature. Alternatively, instead of the halogen heater 23, an induction heater, a resistive heat generator, a carbon heater, or the like may be employed as a heater that heats the fixing belt 21.

A detailed description is now given of a configuration of the nip formation pad 24.

The nip formation pad 24 extends in the axial direction of the fixing belt 21 such that a longitudinal direction of the nip formation pad 24 is parallel to the axial direction of the fixing belt 21. The nip formation pad 24 is secured to and supported by the stay 25, thus being positioned inside the loop formed by the fixing belt 21. The stay 25 is constructed of an upper stay 25-1, a lower stay 25-2, and a right stay 25-3. The side plates 27 support the stay 25 and the holder 26.

The low-friction sheet 28 is sandwiched between the nip formation pad 24 and the inner circumferential surface of the fixing belt 21. The low-friction sheet 28 surrounds a nip-side face 24*a*, an upstream face and a downstream face in the sheet conveyance direction DP, that adjoin the nip-side face 24*a*, and a part of a stay-side face being opposite the nip-side face 24*a* and adjoining the upstream face and the downstream face. Thus, the low-friction sheet 28 covers at least three faces of the nip formation pad 24.

During a fixing job, as the driver rotates the pressure roller 22 clockwise in FIG. 2 in the rotation direction D22, the pressure roller 22 rotates the fixing belt 21 counterclockwise in FIG. 2 in the rotation direction D21. Simultaneously, the halogen heater 23 heats the fixing belt 21 directly. When the fixing belt 21 stores heat sufficiently, conveyance of a sheet P bearing a toner image starts. The sheet P is conveyed upward in FIG. 2 to the fixing nip N. While the sheet P is conveyed through the fixing nip N, the toner image is fixed on the sheet P.

A description is provided of a first example of the fixing device 20 according to the first exemplary embodiment.

Figure 3A:
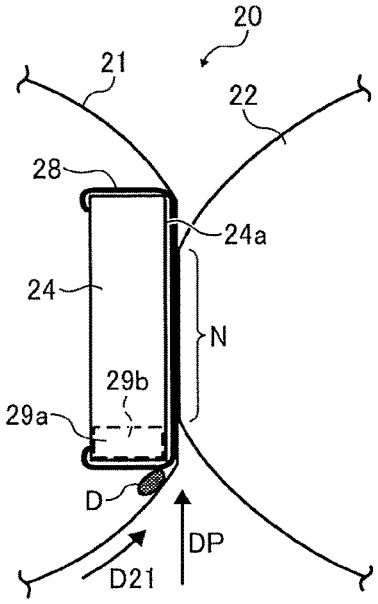
FIG. 3A is a partially enlarged cross-sectional side view of the fixing device depicted in FIG. 2 as a first example.
Figure 3B:
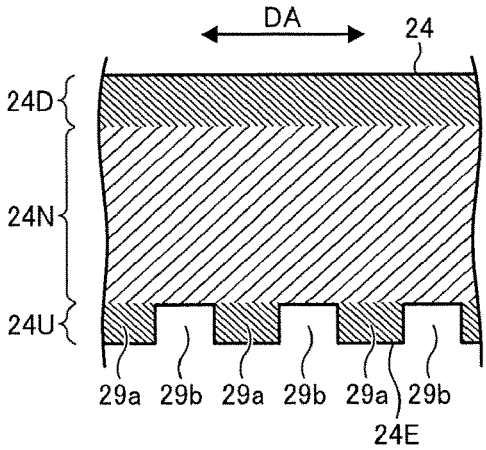
FIG. 3B is a partial front view of a nip formation pad incorporated in the fixing device depicted in FIG. 3A.

FIG. 3A is a partially enlarged cross-sectional side view of the fixing device 20, illustrating the fixing nip N and a periphery of the fixing nip N. FIG. 3B is a partial front view of the nip formation pad 24.

As illustrated in FIG. 3B, the nip formation pad 24 includes a nip forming portion 24N disposed opposite the fixing nip N, an upstream portion 24U disposed upstream from the nip forming portion 24N in the sheet conveyance direction DP, and a downstream portion 24D disposed downstream from the nip forming portion 24N in the sheet conveyance direction DP. The upstream portion 24U mounts a plurality of projections 29*a* that is serrate or is formed in a comb. A recess 29*b* (e.g., a groove) is interposed between the adjacent projections 29*a*.

As illustrated in FIG. 3A, the low-friction sheet 28 is sandwiched between the nip formation pad 24 and the inner circumferential surface of the fixing belt 21. According to this exemplary embodiment, the low-friction sheet 28 is used as a slide sheet over which the fixing belt 21 slides. The nip formation pad 24 presses against the fixing belt 21 via the low-friction sheet 28 such that the fixing belt 21 slides over the low-friction sheet 28. The upstream portion 24U, the nip forming portion 24N, and the downstream portion 24D of the nip formation pad 24 press against the fixing belt 21 via the low-friction sheet 28. The upstream portion 24U, the nip forming portion 24N, and the downstream portion 24D are aligned in this order in the sheet conveyance direction DP corresponding to the rotation direction D21 of the fixing belt 21. The upstream portion 24U, the nip forming portion 24N, and the downstream portion 24D define an upstream pressing span, a nip forming span, and a downstream pressing span, respectively, where the nip formation pad 24 presses against the fixing belt 21 via the low-friction sheet 28. The nip forming portion 24N presses against the pressure roller 22 via the low-friction sheet 28 and the fixing belt 21 to form the fixing nip N.

The recess 29*b* is disposed upstream from the nip forming portion 24N in the sheet conveyance direction DP. A nip-side face, that is, a face disposed opposite the fixing belt 21, of the projection 29*a* disposed in the upstream portion 24U presses against the fixing belt 21 via the low-friction sheet 28 such that the fixing belt 21 slides over the low-friction sheet 28.

A detailed description is now given of a configuration of the low-friction sheet 28.

The low-friction sheet 28 is flexible. Since the low-friction sheet 28 is looped over the projections 29*a* defining the recess 29*b*, as the fixing belt 21 rotating in the rotation direction D21 stretches the low-friction sheet 28, the low-friction sheet 28 is recessed along the recess 29*b*. As an accumulated lubricant D (e.g., accumulated lubricating oil) depicted in FIG. 3A, which is produced at a position in proximity to an entry to the fixing nip N, enters a recessed portion of the low-friction sheet 28 as described below, the recess 29*b* suppresses motion of the lubricant D, preventing the lubricant D from dropping from a lateral end of the fixing belt 21 in an axial direction DA thereof.

A description is provided of a construction of a comparative fixing device.

The comparative fixing device includes an endless fixing belt, a nip formation pad, a support that supports the nip formation pad, and a heater that heats the fixing belt directly. The nip formation pad, the support, and the heater are disposed inside a loop formed by the fixing belt.

In order to decrease a resistance between the fixing belt and the nip formation pad, a low-friction sheet impregnated or applied with a lubricant (e.g., lubricating oil) is sandwiched between the fixing belt and the nip formation pad. When the lubricant is heated, a viscosity of the lubricant decreases and the lubricant may leak from a lateral edge face of the fixing belt in an axial direction thereof to an outside of the fixing belt. Accordingly, a frictional resistance, that is, a driving torque, of the fixing belt may increase over time. Even if the low-friction sheet is wound around the nip formation pad to decrease a sliding friction of the fixing belt sliding over the nip formation pad via the low-friction sheet, the lubricant may move in the axial direction of the fixing belt and leak from the lateral edge face of the fixing belt.

Figure 4:
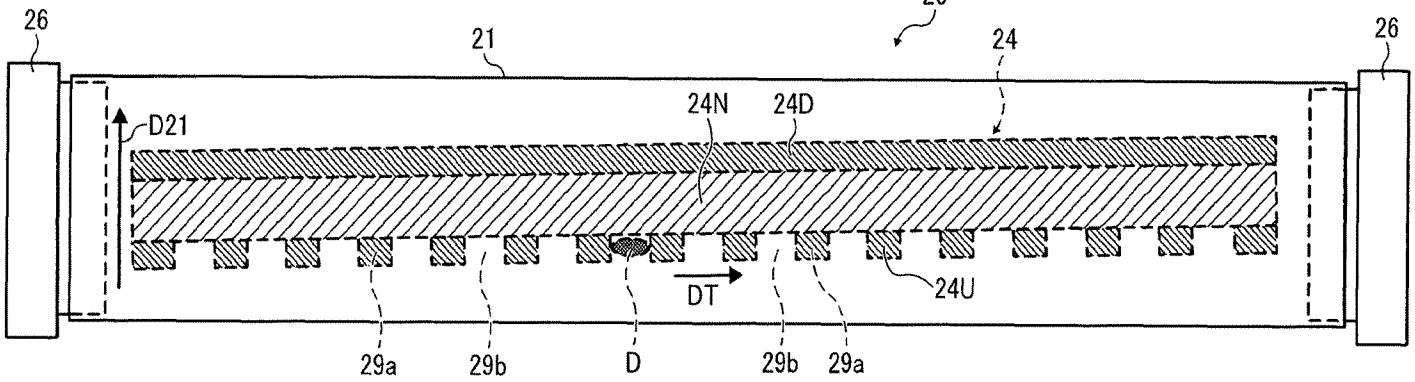
FIG. 4 is a partial front view of the fixing device depicted in FIG. 2.
Figure 5:
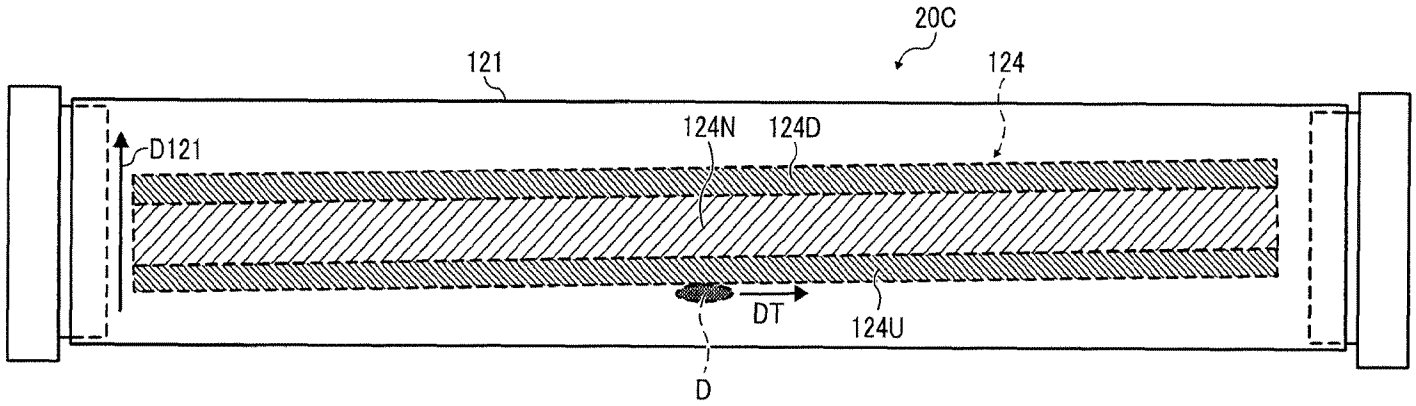
FIG. 5 is a partial front view of a comparative fixing device.

Referring to FIGS. 4 and 5, a description is provided of a function of the recess 29*b*.

FIG. 4 is a partial front view of the fixing device 20. FIG. 5 is a partial front view of a comparative fixing device 20C. As illustrated in FIG. 5, the comparative fixing device 20C includes a fixing belt 121 (e.g., an endless belt or film) rotatable in a rotation direction D121 and a nip formation pad 124. The nip formation pad 124 includes a nip forming portion 124N, an upstream portion 124U disposed upstream from the nip forming portion 124N in the rotation direction D121 of the fixing belt 121, and a downstream portion 124D disposed downstream from the nip forming portion 124N in the rotation direction D121 of the fixing belt 121. A low-friction sheet is sandwiched between the fixing belt 121 and the nip formation pad 124. The low-friction sheet is impregnated or applied with a lubricant (e.g., lubricating oil). During a fixing job when the fixing belt 121 rotates in the rotation direction D121, the lubricant seeping from the low-friction sheet spreads over an inner circumferential surface of the fixing belt 121 thinly. When the lubricant on the fixing belt 121 returns to an upstream end of the nip formation pad 124 in accordance with rotation of the fixing belt 121, the lubricant is collected by the low-friction sheet and returns to a nip-side face of the low-friction sheet, that faces the inner circumferential surface of the fixing belt 121. However, if the lubricant returns to the low-friction sheet at a speed that exceeds an absorption capacity of the low-friction sheet, the lubricant may accumulate as an accumulated lubricant D at a position in proximity to the upstream end of the nip formation pad 124.

Accordingly, if a contact portion of the nip formation pad 124, that presses against the fixing belt 121 via the low-friction sheet, is tilted in a tilt direction DT as illustrated in FIG. 5, that is, if a longitudinal direction of the nip formation pad 124 is not parallel to an axial direction of the fixing belt 121, the accumulated lubricant D flows right upward in FIG. 5 in the tilt direction DT. Consequently, the accumulated lubricant D may leak from a lateral edge face of the fixing belt 121 in the axial direction thereof. FIGS. 4 and 5 illustrate the upstream portions 24U and 124U and the downstream portions 24D and 124D with a hatching defined by right downward oblique lines used in FIG. 3B. Similarly, FIGS. 4 and 5 illustrate the nip forming portions 24N and 124N with a hatching defined by right upward oblique lines used in FIG. 3B.

Contrarily to the nip formation pad 124 of the comparative fixing device 20C depicted in FIG. 5, the nip formation pad 24 of the fixing device 20 illustrated in FIGS. 3B and 4 includes the upstream portion 24U mounting the recess 29*b*. The recess 29*b* prevents the accumulated lubricant D produced at the position in proximity to the entry to the fixing nip N from moving in the tilt direction DT and leaking from the lateral end of the fixing belt 21 in the axial direction DA thereof. As the fixing belt 21 rotates in the rotation direction D21, the accumulated lubricant D blocked by the recess 29*b* is guided by the recess 29*b* toward the nip forming portion 24N gradually. Accordingly, the lubricant D situated in the nip forming portion 24N suppresses increase in a frictional resistance and a driving torque of the fixing belt 21 over time.

The above describes advantages of the recess 29*b* of the nip formation pad 24 tilted in the tilt direction DT as illustrated in FIG. 4 such that the longitudinal direction of the nip formation pad 24 is not parallel to the axial direction DA of the fixing belt 21. Alternatively, the recess 29*b* may be applied to the nip formation pad 24 that is not tilted. Even if the nip formation pad 24 is not tilted, the recess 29*b* prevents the lubricant D seeped from the low-friction sheet 28 and returned to an upstream end 24E depicted in FIG. 3B of the nip formation pad 24 from moving to the lateral end of the fixing belt 21 in the axial direction DA thereof. Accordingly, the recess 29*b* reduces leakage of the lubricant D from the lateral end of the fixing belt 21 in the axial direction DA thereof. Consequently, in this case also, the lubricant D situated in the nip forming portion 24N suppresses increase in the frictional resistance and the driving torque of the fixing belt 21 over time.

The nip formation pad 24 is made of resin or metal such as copper. The nip formation pad 24 made of resin is manufactured at reduced costs although the nip formation pad 24 has a complex structure with the recess 29*b*. The nip formation pad 24 made of metal attains an enhanced thermal conductivity that facilitates conduction of heat in the longitudinal direction of the nip formation pad 24, thus equalizing heat stored in the fixing belt 21 in the axial direction DA thereof. Accordingly, even after a plurality of small sheets P, which does not pass through a lateral end span of the fixing belt 21 in the axial direction DA thereof and therefore does not draw heat from the lateral end span of the fixing belt 21, is conveyed through the fixing nip N continuously, the lateral end span of the fixing belt 21 does not overheat. The nip formation pad 24 made of copper equalizes heat stored in the fixing belt 21 effectively.

Figure 6A:
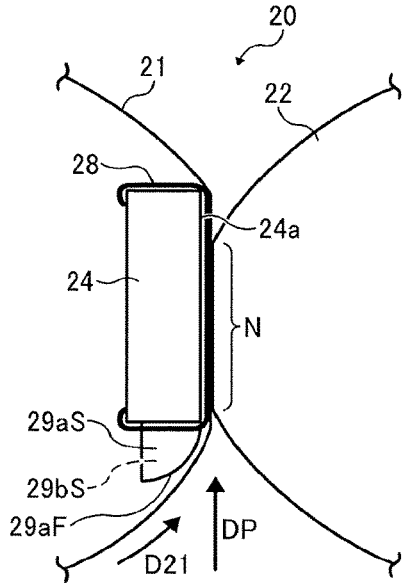
FIG. 6A is a partially enlarged cross-sectional side view of the fixing device depicted in FIG. 2 as a second example.
Figure 6B:
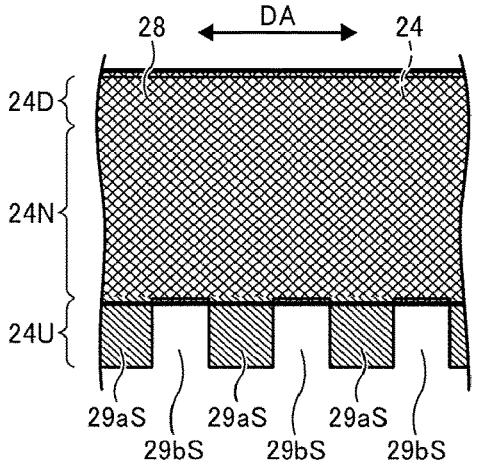
FIG. 6B is a partial front view of the nip formation pad incorporated in the fixing device depicted in FIG. 6A.

Referring to FIGS. 6A and 6B, a description is provided of a second example of the fixing device 20 according to the first exemplary embodiment, which includes a projection 29*a*S and a recess 29*b*S.

FIG. 6A is a partially enlarged cross-sectional side view of the fixing device 20 installed with the projection 29*a*S and the recess 29*b*S. FIG. 6B is a partial front view of the nip formation pad 24 mounting the projection 29*a*S and the recess 29*b*S. As illustrated in FIGS. 6A and 6B, the projection 29*a*S disposed in the upstream portion 24U of the nip formation pad 24 projects beyond the low-friction sheet 28 in a direction opposite the sheet conveyance direction DP. For example, the projection 29*a*S is exposed from the low-friction sheet 28.

As illustrated in FIG. 6B, a plurality of projections 29*a*S is disposed in the upstream portion 24U of the nip formation pad 24. The low-friction sheet 28 includes a plurality of slits or a plurality of through-holes that corresponds to the plurality of projections 29*a*S. The projections 29*a*S project beyond the low-friction sheet 28 in the direction opposite the sheet conveyance direction DP, that is, a direction opposite the rotation direction D21 of the fixing belt 21, through the slits or the through-holes of the low-friction sheet 28, respectively. The recess 29*b*S (e.g., a groove) disposed in the upstream portion 24U and interposed between the adjacent projections 29*a*S also projects beyond the low-friction sheet 28 in the direction opposite the sheet conveyance direction DP. As illustrated in FIG. 6A, an opposed face 29*a*F of the projection 29*a*S is disposed opposite the inner circumferential surface of the fixing belt 21. The opposed face 29*a*F is a curved face curved in cross-section.

The recess 29*b*S is disposed outside and upstream from the low-friction sheet 28 in the rotation direction D21 of the fixing belt 21. Accordingly, the recess 29*b*S effectively suppresses motion of the accumulated lubricant D produced at the position in proximity to the entry to the fixing nip N as illustrated in FIG. 3A. Consequently, the recess 29*b*S prevents leakage of the lubricant D from the lateral end of the fixing belt 21 in the axial direction DA thereof effectively.

The projection 29*a*S may be molded with the nip formation pad 24. Alternatively, the projection 29*a*S may be manufactured separately from the nip formation pad 24 and attached to the nip formation pad 24. If the projection 29*a*S is manufactured separately from the nip formation pad 24, the projection 29*a*S may be attached to the nip formation pad 24 after the low-friction sheet 28 is wound around or attached to the nip formation pad 24.

If the projection 29*a*S situated outside the low-friction sheet 28 is projected beyond and exposed from the low-friction sheet 28 as illustrated in FIG. 6A, the low-friction sheet 28 is not interposed between the projection 29*a*S and the fixing belt 21. Hence, the frictional resistance may increase between the projection 29*a*S and the fixing belt 21. To address this circumstance, the low-friction sheet 28 covers the opposed face 29*a*F of the projection 29*a*S as illustrated in FIGS. 7A and 7B.

Figure 7A:
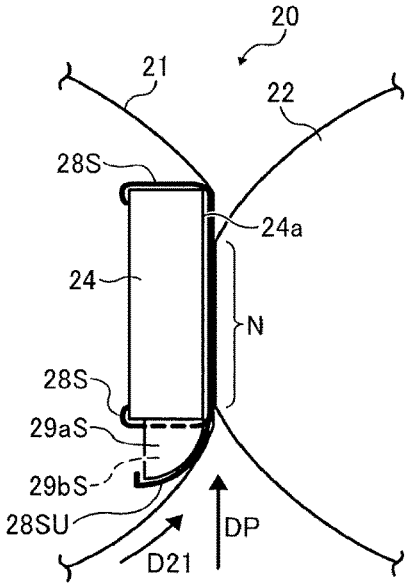
FIG. 7A is a partially enlarged cross-sectional side view of the fixing device depicted in FIG. 2 as a third example.
Figure 7B:
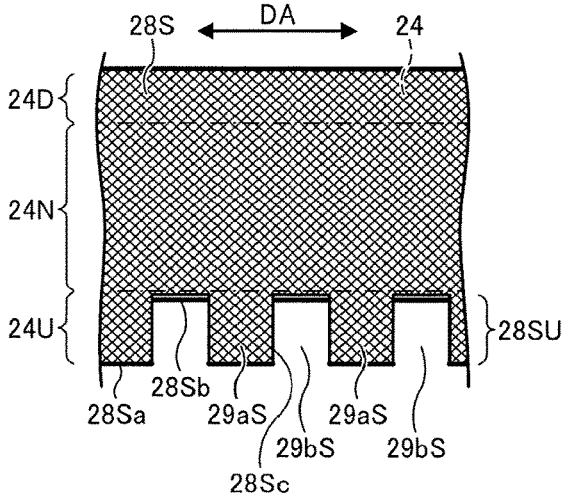
FIG. 7B is a partial front view of the nip formation pad incorporated in the fixing device depicted in FIG. 7A.

Referring to FIGS. 7A and 7B, a description is provided of a third example of the fixing device 20 according to the first exemplary embodiment, that includes a low-friction sheet 28S.

FIG. 7A is a partially enlarged cross-sectional side view of the fixing device 20 installed with the low-friction sheet 28S. FIG. 7B is a partial front view of the nip formation pad 24 and the low-friction sheet 28S.

As illustrated in FIGS. 7A and 7B, the low-friction sheet 28S includes an upstream portion 28SU disposed opposite the upstream portion 24U of the nip formation pad 24. The upstream portion 28SU is an upstream end portion of the low-friction sheet 28S in the rotation direction D21 of the fixing belt 21. As illustrated in FIG. 7B, the upstream portion 28SU includes a slit 28Sc disposed opposite a boundary between the projection 29*a*S and the recess 29*b*S. The upstream portion 28SU has a portiere shape or a shop curtain shape. The upstream portion 28SU includes a projecting portion 28Sa disposed opposite the projection 29*a*S and a recessed portion 28Sb disposed opposite the recess 29*b*S. The projecting portion 28Sa covers or is wound around the projection 29*a*S. The recessed portion 28Sb covers or is wound around the recess 29*b*S. Accordingly, as illustrated in FIG. 7A, the low-friction sheet 28S covers the entire nip-side face 24*a* of the nip formation pad 24 that is disposed opposite the fixing belt 21.

The entire nip-side face 24*a* encompasses the downstream portion 24D, the nip forming portion 24N, the upstream portion 24U, and the projection 29*a*S disposed in the upstream portion 24U. Thus, the frictional resistance between the nip formation pad 24 and the fixing belt 21 does not increase. The recess 29*b*S is outside the low-friction sheet 28S. Accordingly, the recess 29*b*S effectively suppresses motion of the accumulated lubricant D produced at the position in proximity to the entry to the fixing nip N as illustrated in FIG. 3A. Consequently, the recess 29*b*S prevents leakage of the lubricant D from the lateral end of the fixing belt 21 in the axial direction DA thereof effectively. The projection 29*a*S may be molded with the nip formation pad 24. Alternatively, the projection 29*a*S may be manufactured separately from the nip formation pad 24 and attached to the nip formation pad 24.

A description is provided of a fourth example of the fixing device 20 according to the first exemplary embodiment.

Figure 8A:
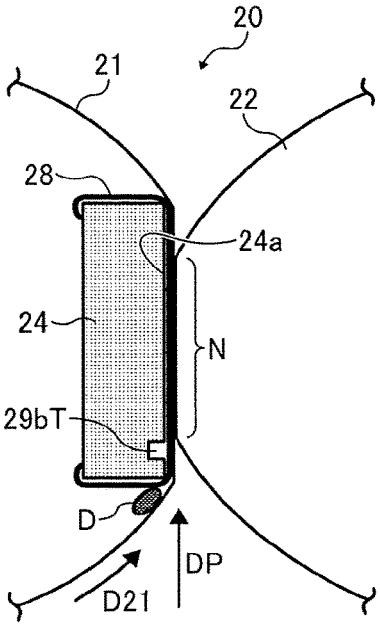
FIG. 8A is a partially enlarged cross-sectional side view of the fixing device depicted in FIG. 2 as a fourth example.
Figure 8B:
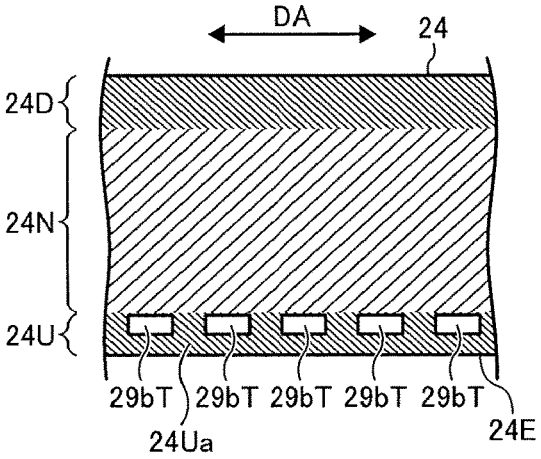
FIG. 8B is a partial front view of the nip formation pad incorporated in the fixing device depicted in FIG. 8A.
Figure 9:
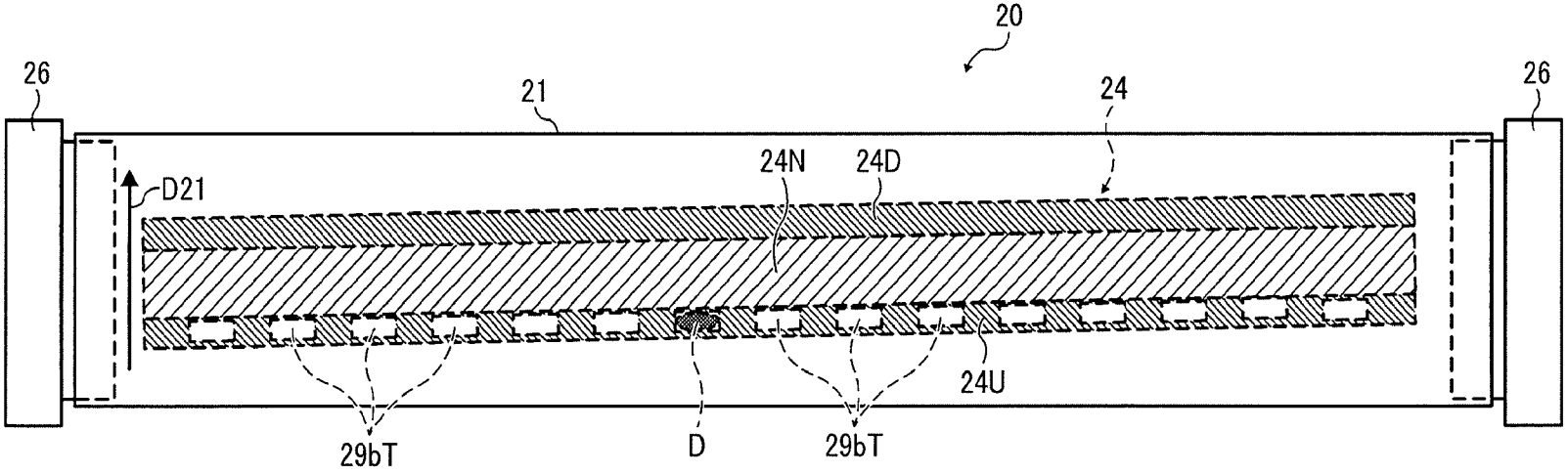
FIG. 9 is a partial front view of the fixing device depicted in FIG. 8A.

FIG. 8A is a partially enlarged cross-sectional side view of the fixing device 20, illustrating the fixing nip N and the periphery of the fixing nip N. FIG. 8B is a partial front view of the nip formation pad 24. FIG. 9 is a partial front view of the fixing device 20 as the fourth example.

As illustrated in FIG. 8A, a recess 29*b*T is mounted on the nip-side face 24*a* of the nip formation pad 24. The recess 29*b*T is disposed in proximity to the upstream end 24E depicted in FIG. 8B of the nip formation pad 24 in the rotation direction D21 of the fixing belt 21, that is, a lower end of the nip formation pad 24 in FIG. 8A. As illustrated in FIG. 8B, the recess 29*b*T does not extend continuously in the axial direction DA of the fixing belt 21 parallel to the longitudinal direction of the nip formation pad 24. The recess 29*b*T is discontinuous in the axial direction DA of the fixing belt 21. For example, a plurality of recesses 29*b*T is aligned in the axial direction DA of the fixing belt 21.

As illustrated in FIG. 8A, the low-friction sheet 28 is sandwiched between the nip formation pad 24 and the inner circumferential surface of the fixing belt 21. The nip formation pad 24 presses against the fixing belt 21 via the low-friction sheet 28 such that the fixing belt 21 slides over the low-friction sheet 28. As illustrated in FIG. 8B, the upstream portion 24U, the nip forming portion 24N, and the downstream portion 24D of the nip formation pad 24 press against the fixing belt 21 via the low-friction sheet 28. The upstream portion 24U, the nip forming portion 24N, and the downstream portion 24D are aligned in this order in the sheet conveyance direction DP corresponding to the rotation direction D21 of the fixing belt 21. The upstream portion 24U, the nip forming portion 24N, and the downstream portion 24D define the upstream pressing span, the nip forming span, and the downstream pressing span, respectively, where the nip formation pad 24 presses against the fixing belt 21 via the low-friction sheet 28. The nip forming portion 24N presses against the pressure roller 22 via the low-friction sheet 28 and the fixing belt 21 to form the fixing nip N.

The recess 29*b*T is disposed opposite the upstream portion 24U and disposed upstream from the nip forming portion 24N in the rotation direction D21 of the fixing belt 21. A nip-side face 24Ua of the upstream portion 24U, that is other than the recess 29*b*T and is disposed opposite the fixing belt 21, presses against the fixing belt 21 via the low-friction sheet 28 such that the fixing belt 21 slides over the nip-side face 24Ua of the nip formation pad 24 via the low-friction sheet 28.

Although the recess 29*b*T is recessed from the nip-side face 24Ua of the upstream portion 24U, the low-friction sheet 28 is recessed along the recess 29*b*T. The accumulated lubricant D (e.g., accumulated lubricating oil) which is produced at the position in proximity to the entry to the fixing nip N enters the recessed portion of the low-friction sheet 28 as illustrated in FIG. 9, which suppresses motion of the lubricant D and prevents the lubricant D from dropping from the lateral end of the fixing belt 21 in the axial direction DA thereof.

A description is provided of a construction of a fixing device 20S according to a second exemplary embodiment, that is installable in the image forming apparatus 1 depicted in FIG. 1.

Figure 10A:
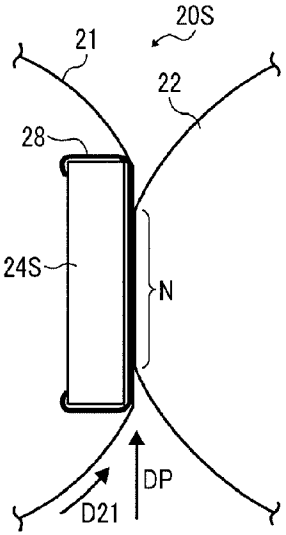
FIG. 10A is a partially enlarged cross-sectional side view of a fixing device according to a second exemplary embodiment of the present disclosure that is installable in the image forming apparatus depicted in FIG. 1.
Figure 10B:
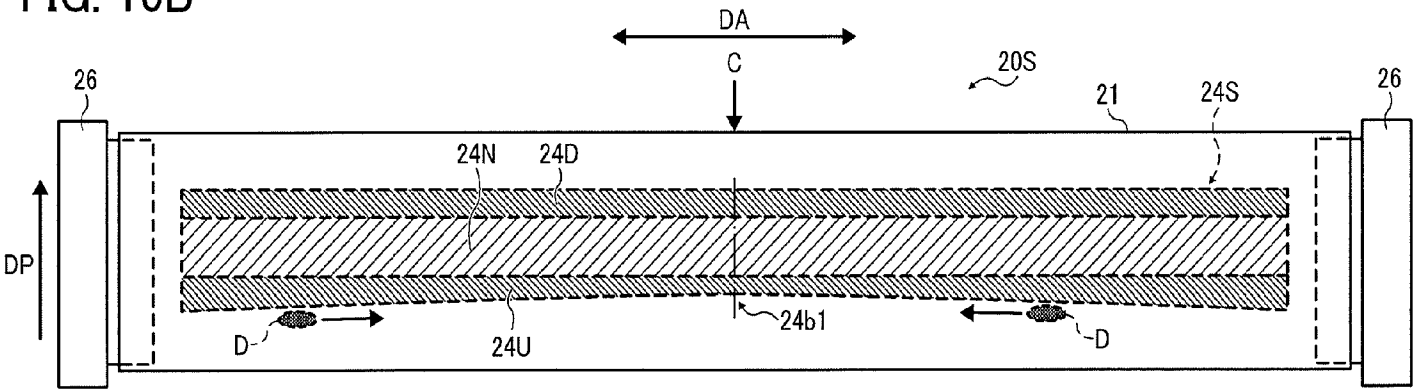
FIG. 10B is a partial front view of the fixing device depicted in FIG. 10A.

FIG. 10A is a partially enlarged cross-sectional side view of the fixing device 20S, illustrating the fixing nip N and the periphery of the fixing nip N. FIG. 10B is a partial front view of the fixing device 20S. A basic construction of the fixing device 20S is equivalent to the construction of the fixing device 20 depicted in FIG. 2. The following describes a construction of the fixing device 20S according to the second exemplary embodiment that is different from the construction of the fixing device 20 according to the first exemplary embodiment described above. Thus, a description of the basic construction of the fixing device 20S that is equivalent to the construction of the fixing device 20 is omitted.

Figure 11A:
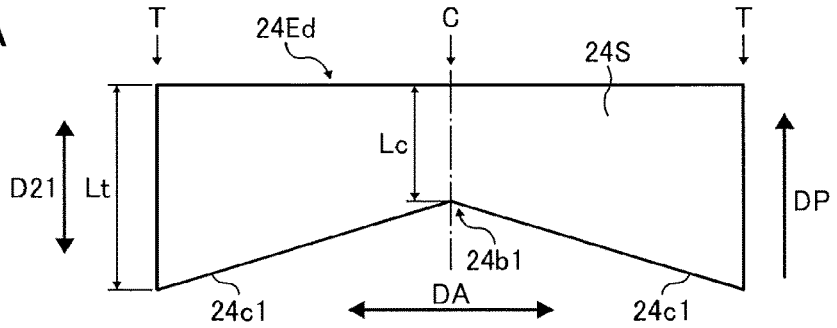
FIG. 11A is a front view of a nip formation pad incorporated in the fixing device depicted in FIG. 10A, illustrating a recess as a first example.

As illustrated in FIGS. 10A and 10B, the fixing device 20S includes a nip formation pad 24S that does not mount the recess 29*b*. As illustrated in FIG. 10B, the nip formation pad 24S includes a recess 24*b*1 disposed substantially at a center C of the nip formation pad 24S in a longitudinal direction thereof. The recess 24*b*1 is disposed in the upstream portion 24U and is recessed toward the nip forming portion 24N disposed downstream from the upstream portion 24U in the sheet conveyance direction DP or the rotation direction D21 of the fixing belt 21. FIGS. 11A, 11B, 11C, 11D, and 11E illustrate five examples of the nip formation pad 24S. FIG. 11A illustrates the recess 24*b*1 depicted in FIG. 10B.

A detailed description is now given of a construction of the nip formation pad 24S.

FIGS. 11A, 11B, 11C, 11D, and 11E illustrate the five examples of the nip formation pad 24S installed in the fixing device 20S according to the second exemplary embodiment depicted in FIG. 10A. FIGS. 11A, 11B, 11C, 11D, and 11E illustrate a front view of the nip formation pad 24S seen from the fixing nip N and the pressure roller 22 depicted in FIG. 10A. FIGS. 11A, 11B, 11C, 11D, and 11E emphasize an advantageous configuration of the nip formation pad 24S.

As illustrated in FIGS. 11A, 11B, 11C, 11D, and 11E, the nip formation pad 24S includes a recess disposed substantially at the center C of the nip formation pad 24S in the longitudinal direction thereof parallel to the axial direction DA of the fixing belt 21. The recess is disposed in the upstream portion 24U of the nip formation pad 24S in the rotation direction D21 of the fixing belt 21 and situated in proximity to the entry to the fixing nip N. The recess is recessed toward the nip forming portion 24N of the nip formation pad 24S in the sheet conveyance direction DP or the rotation direction D21 of the fixing belt 21.

For example, as illustrated in FIG. 11A, a center length Lc in the sheet conveyance direction DP at the center C of the nip formation pad 24S in the longitudinal direction thereof or the axial direction DA of the fixing belt 21 is different from a lateral edge length Lt in the sheet conveyance direction DP at a lateral edge T of the nip formation pad 24S in the longitudinal direction thereof. The center length Lc is smaller than the lateral edge length Lt.

A downstream edge 24Ed of the nip formation pad 24S is parallel to the axial direction DA of the fixing belt 21. Accordingly, a center portion of the nip formation pad 24S in the longitudinal direction thereof, which is disposed in the upstream portion 24U of the nip formation pad 24S, is recessed toward the nip forming portion 24N of the nip formation pad 24S in the rotation direction D21 of the fixing belt 21 or the sheet conveyance direction DP, thus defining the recess 24*b*1. Alternatively, the downstream edge 24Ed may not be parallel to the axial direction DA of the fixing belt 21. Even if the downstream edge 24Ed is not parallel to the axial direction DA of the fixing belt 21, the center portion of the nip formation pad 24S in the longitudinal direction thereof, which is disposed in the upstream portion 24U of the nip formation pad 24S, is recessed toward the nip forming portion 24N of the nip formation pad 24S in the rotation direction D21 of the fixing belt 21 or the sheet conveyance direction DP, thus defining the recess 24*b*1.

FIGS. 11A, 11B, 11C, 11D, and 11E illustrate the five examples of the nip formation pad 24S incorporating recesses 24*b*1, 24*b*2, 24*b*3, 24*b*4, and 24*b*5, respectively. The recesses 24*b*1, 24*b*2, 24*b*3, 24*b*4, and 24*b*5 prevent the accumulated lubricant D (e.g., lubricating oil) depicted in FIG. 10B, that is produced at the position in proximity to the entry to the fixing nip N from flowing out of the lateral end of the fixing belt 21 in the axial direction DA thereof. The recesses 24*b*1, 24*b*2, 24*b*3, 24*b*4, and 24*b*5 guide the lubricant D to the low-friction sheet 28 disposed opposite the fixing nip N. Thus, the recesses 24*b*1, 24*b*2, 24*b*3, 24*b*4, and 24*b*5 prevent leakage of the lubricant D from the lateral end of the fixing belt 21 in the axial direction DA thereof.

A detailed description is now given of a configuration of the recess 24*b*1 as a first example of the nip formation pad 24S.

FIG. 11A is a front view of the nip formation pad 24S, illustrating the recess 24*b*1. As illustrated in FIG. 11A, the recess 24*b*1 is disposed in the upstream portion 24U of the nip formation pad 24S and has an inverse V shape. The recess 24*b*1 defines a linear slope 24*c*1 that increases an area of the upstream portion 24U of the nip formation pad 24S from the center C to the lateral edge T of the nip formation pad 24S in the longitudinal direction thereof. In other words, the linear slope 24*c*1 increases a length of the nip formation pad 24S in the rotation direction D21 of the fixing belt 21 from the center C to the lateral edge T of the nip formation pad 24S in the longitudinal direction thereof. As illustrated in FIG. 10B, the recess 24*b*1 guides the accumulated lubricant D produced at the position in proximity to the entry to the fixing nip N toward the center C of the nip formation pad 24S in the longitudinal direction thereof, preventing the lubricant D from leaking from a lateral edge face of the fixing belt 21 in the axial direction DA thereof.

A detailed description is now given of a configuration of the recess 24*b*2 as a second example of the nip formation pad 24S.

Figure 11B:
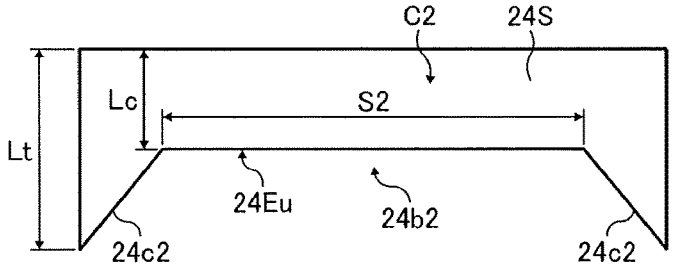
FIG. 11B is a front view of the nip formation pad incorporated in the fixing device depicted in FIG. 10A, illustrating a recess as a second example.

FIG. 11B is a front view of the nip formation pad 24S, illustrating the recess 24*b*2. As illustrated in FIG. 11B, the recess 24*b*2 defines a center portion C2 of the nip formation pad 24S, that has a predetermined center span S2 in the longitudinal direction of the nip formation pad 24S. The center portion C2 has the constant center length Lc in the rotation direction D21 of the fixing belt 21. The recess 24*b*2 defines a linear slope 24*c*2 that increases the area of the upstream portion 24U of the nip formation pad 24S from the center span S2 to the lateral edge T of the nip formation pad 24S in the longitudinal direction thereof. In other words, the linear slope 24*c*2 increases the length of the nip formation pad 24S in the rotation direction D21 of the fixing belt 21 from a lateral edge of the center portion C2 to the lateral edge T of the nip formation pad 24S in the longitudinal direction thereof. The linear slope 24*c*2 defined by the recess 24*b*2 and disposed at each lateral end of the nip formation pad 24S in the longitudinal direction thereof guides the accumulated lubricant D produced at the position in proximity to the entry to the fixing nip N toward the center portion C2 of the nip formation pad 24S in the longitudinal direction thereof, preventing the lubricant D from leaking from the lateral edge face of the fixing belt 21 in the axial direction DA thereof.

A detailed description is now given of a configuration of the recess 24*b*3 as a third example of the nip formation pad 24S.

Figure 11C:
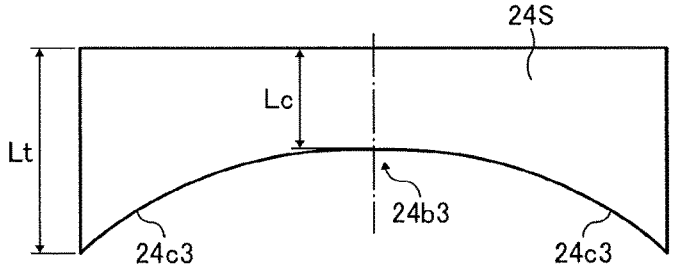
FIG. 11C is a front view of the nip formation pad incorporated in the fixing device depicted in FIG. 10A, illustrating a recess as a third example.

FIG. 11C is a front view of the nip formation pad 24S, illustrating the recess 24*b*3. As illustrated in FIG. 11C, the recess 24*b*3 is disposed in the upstream portion 24U of the nip formation pad 24S and is curved. The recess 24*b*3 defines a curve 24*c*3 that increases the area of the upstream portion 24U of the nip formation pad 24S from the center C to the lateral edge T of the nip formation pad 24S in the longitudinal direction thereof. In other words, the curve 24*c*3 increases the length of the nip formation pad 24S in the rotation direction D21 of the fixing belt 21 from the center C to the lateral edge T of the nip formation pad 24S in the longitudinal direction thereof. The curve 24*c*3 has an arbitrary shape, for example, an arch. The recess 24*b*3 guides the accumulated lubricant D produced at the position in proximity to the entry to the fixing nip N toward the center C of the nip formation pad 24S in the longitudinal direction thereof, preventing the lubricant D from leaking from the lateral edge face of the fixing belt 21 in the axial direction DA thereof.

A detailed description is now given of a configuration of the recess 24*b*4 as a fourth example of the nip formation pad 24S.

Figure 11D:
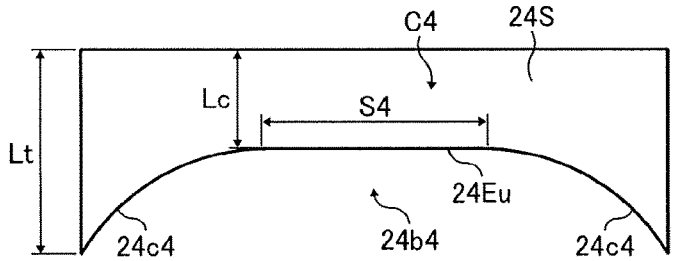
FIG. 11D is a front view of the nip formation pad incorporated in the fixing device depicted in FIG. 10A, illustrating a recess as a fourth example.

FIG. 11D is a front view of the nip formation pad 24S, illustrating the recess 24*b*4. As illustrated in FIG. 11D, the nip formation pad 24S includes a center portion C4 having a predetermined center span S4 in the longitudinal direction of the nip formation pad 24S. The center portion C4 has the constant center length Lc in the sheet conveyance direction DP. The recess 24*b*4 defines a curved slope 24*c*4 that increases the area of the upstream portion 24U of the nip formation pad 24S from a lateral edge of the center portion C4 to the lateral edge T of the nip formation pad 24S in the longitudinal direction thereof. In other words, the curved slope 24*c*4 increases the length of the nip formation pad 24S in the rotation direction D21 of the fixing belt 21 from the lateral edge of the center portion C4 to the lateral edge T of the nip formation pad 24S in the longitudinal direction thereof. The curved slope 24*c*4 has an arbitrary shape, for example, an arch. The curved slope 24*c*4 defined by the recess 24*b*4 and disposed at each lateral end of the nip formation pad 24S in the longitudinal direction thereof guides the accumulated lubricant D produced at the position in proximity to the entry to the fixing nip N toward the center portion C4 of the nip formation pad 24S in the longitudinal direction thereof, preventing the lubricant D from leaking from the lateral edge face of the fixing belt 21 in the axial direction DA thereof.

A detailed description is now given of a configuration of the recess 24*b*5 as a fifth example of the nip formation pad 24S.

Figure 11E:
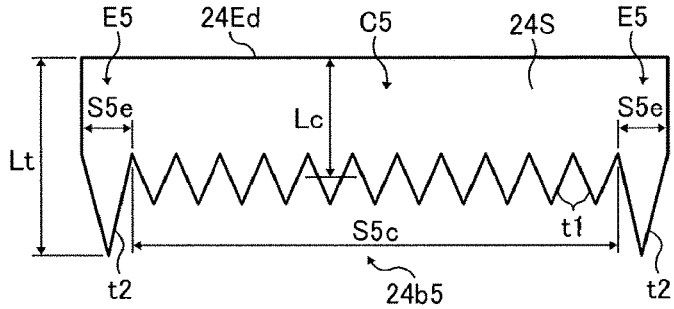
FIG. 11E is a front view of the nip formation pad incorporated in the fixing device depicted in FIG. 10A, illustrating a recess as a fifth example.

FIG. 11E is a front view of the nip formation pad 24S, illustrating the recess 24*b*5. As illustrated in FIG. 11E, the recess 24*b*5 is disposed in the upstream portion 24U of the nip formation pad 24S and is serrated. As illustrated in FIG. 11E, the nip formation pad 24S includes a center portion C5 having a predetermined center span S5*c* in the longitudinal direction of the nip formation pad 24S, that has the constant center length Lc in the rotation direction D21 of the fixing belt 21 or the sheet conveyance direction DP. The center portion C5 includes a plurality of teeth t1 that has a constant length in the rotation direction D21 of the fixing belt 21. The center length Lc is defined between the downstream edge 24Ed and a mid-slope between a crest and a trough of the tooth t1. The nip formation pad 24S further includes a lateral end portion E5 having a lateral end span S5*e* disposed outboard from the center span S5*c* in the longitudinal direction of the nip formation pad 24S. The lateral end portion E5 is disposed at each lateral end of the nip formation pad 24S and disposed outboard from the center portion C5 in the longitudinal direction of the nip formation pad 24S. The lateral end portion E5 has a tooth t2 having a length in the rotation direction D21 of the fixing belt 21, that is greater than the length of the tooth t1 of the center portion C5. Like the recess 29*b* depicted in FIG. 3B, the tooth t1 defined by the crest and the trough prevents the accumulated lubricant D produced at the position in proximity to the entry to the fixing nip N from moving in the axial direction DA of the fixing belt 21, thus preventing the lubricant D from leaking from the lateral edge face of the fixing belt 21 in the axial direction DA thereof.

As illustrated in FIGS. 11A, 11B, 11C, 11D, and 11E, the nip formation pad 24S does not mount the recess 29*b* unlike the nip formation pad 24 mounting the recess 29*b* as illustrated in FIG. 3A. Instead of mounting the recess 29*b*, the upstream portion 24U of the nip formation pad 24S includes the recess 24*b*1, 24*b*2, 24*b*3, 24*b*4, or 24*b*5 that is recessed toward the nip forming portion 24N in the rotation direction D21 of the fixing belt 21 substantially at the center C or in the center span S2, S4, or S5*c* of the nip formation pad 24S in the longitudinal direction thereof, thus preventing the lubricant D from leaking from the lateral edge face of the fixing belt 21 in the axial direction DA thereof.

Alternatively, like the fixing device 20 according to the first exemplary embodiment, the fixing device 20S according to the second exemplary embodiment may incorporate the nip formation pad 24S that mounts the recess 29*b* like the nip formation pad 24 that mounts the recess 29*b*.

For example, if the nip formation pad 24S depicted in FIG. 11A mounts the recess 29*b*, the plurality of recesses 29*b* depicted in FIG. 3B is aligned along each linear slope 24*c*1.

If the nip formation pad 24S depicted in FIG. 11B mounts the recess 29*b*, the plurality of recesses 29*b* depicted in FIG. 3B is aligned along an upstream edge 24Eu of the nip formation pad 24S including each linear slope 24*c*2.

If the nip formation pad 24S depicted in FIG. 11C mounts the recess 29*b*, the plurality of recesses 29*b* depicted in FIG. 3B is aligned along the curve 24*c*3.

If the nip formation pad 24S depicted in FIG. 11D mounts the recess 29*b*, the plurality of recesses 29*b* depicted in FIG. 3B is aligned along the upstream edge 24Eu of the nip formation pad 24S including each curved slope 24*c*4.

As illustrated in FIG. 11E, each of the recesses 24*b*5 that is serrated and defines the crest and the trough of the tooth t1 attains advantages of the recess 29*b*. Hence, the nip formation pad 24S depicted in FIG. 11E does not mount the recess 29*b*.

A description is provided of an aspect of the fixing devices 20 and 20S.

As illustrated in FIGS. 2 and 10A, a fixing device (e.g., the fixing devices 20 and 20S) includes an endless fixing rotator (e.g., the fixing belt 21), a heater (e.g., the halogen heater 23), a pressure rotator (e.g., the pressure roller 22), a nip formation pad (e.g., the nip formation pads 24 and 24S), and a friction reducer (e.g., the low-friction sheets 28 and 28S).

The fixing rotator is formed into a loop and rotatable in a rotation direction (e.g., the rotation direction D21). The heater is disposed opposite the fixing rotator and heats the fixing rotator. The pressure rotator contacts an outer circumferential surface of the fixing rotator. The nip formation pad is disposed inside the loop formed by the fixing rotator and presses against the pressure rotator via the fixing rotator to form a fixing nip (e.g., the fixing nip N) between the fixing rotator and the pressure rotator. The friction reducer is sandwiched between the nip formation pad and the fixing rotator and carries a lubricant (e.g., the lubricant D). For example, the friction reducer is applied or impregnated with the lubricant.

A detailed description is now given of the aspect of the fixing device 20.

As illustrated in FIGS. 3B, 6B, 7B, and 8B, the fixing device 20 further includes a recess (e.g., the recesses 29*b*, 29*b*S, and 29*b*T) disposed opposite the fixing rotator. The nip formation pad (e.g., the nip formation pad 24) includes an upstream portion (e.g., the upstream portion 24U) disposed upstream from the fixing nip in the rotation direction of the fixing rotator. The recess is disposed in the upstream portion of the nip formation pad. The nip formation pad further includes an upstream end (e.g., the upstream end 24E) in the rotation direction of the fixing rotator. The recess adjoins or is disposed in proximity to the upstream end of the nip formation pad.

A detailed description is now given of the aspect of the fixing device 20S.

As illustrated in FIG. 10B, the nip formation pad (e.g., the nip formation pad 24S) includes a nip forming portion (e.g., the nip forming portion 24N) disposed opposite the fixing nip and an upstream portion (e.g., the upstream portion 24U) disposed upstream from the nip forming portion in the rotation direction of the fixing rotator. As illustrated in FIGS. 11A, 11B, 11C, 11D, and 11E, the upstream portion including a recess (e.g., the recesses 24*b*1, 24*b*2, 24*b*3, 24*b*4, and 24*b*5) disposed substantially at a center (e.g., the center C) of the nip formation pad in a longitudinal direction thereof. The recess is recessed toward the nip forming portion in the rotation direction of the fixing rotator.

As illustrated in FIGS. 3B, 6B, 7B, and 8B, the recess (e.g., the recesses 29*b*, 29*b*S, and 29*b*T) is disposed in the upstream portion of the nip formation pad (e.g., the nip formation pad 24) and disposed opposite the fixing rotator. The recess adjoins or is disposed in proximity to the upstream end of the nip formation pad in the rotation direction of the fixing rotator. Accordingly, the recess prevents the lubricant from flowing out of a lateral end of the fixing rotator in an axial direction thereof. Consequently, the recess suppresses increase in a driving torque of the fixing rotator over time.

Since the recess is disposed upstream from the nip forming portion in the rotation direction of the fixing rotator, the recess suppresses leakage of the lubricant without degrading a fixing performance. Since a part of a nip-side face (e.g., the nip-side face 24*a*) other than the recess presses against the fixing rotator via the friction reducer, the recess suppresses leakage of the lubricant from the friction reducer and guides the lubricant toward the nip forming portion of the nip formation pad.

As illustrated in FIGS. 11A, 11B, 11C, 11D, and 11E, the nip formation pad (e.g., the nip formation pad 24S) includes the recess (e.g., the recesses 24*b*1, 24*b*2, 24*b*3, 24*b*4, and 24*b*5) disposed in the upstream portion. The recess is disposed substantially at the center of the nip formation pad in the longitudinal direction of the nip formation pad. The recess is recessed toward the nip forming portion in the rotation direction of the fixing rotator, thus defining a center portion (e.g., the center portions C2, C4, and C5) in the longitudinal direction of the nip formation pad. Accordingly, the recess prevents the accumulated lubricant produced at the position in proximity to the entry to the fixing nip from leaking from a lateral edge face of the fixing rotator in the axial direction thereof. Consequently, the recess suppresses increase in the driving torque of the fixing rotator over time.

The present disclosure is not limited to the details of the exemplary embodiments described above and various modifications and improvements are possible. For example, the recess (e.g., the recesses 29*b*, 29*b*S, 29*b*T, 24*b*1, 24*b*2, 24*b*3, 24*b*4, and 24*b*5) is one example. The size, the depth, the shape, and the like of the recess may be modified or adjusted according to the type and the amount of the lubricant including the lubricating oil impregnated into or applied to the low-friction sheets 28 and 28S, the material and the surface property of the low-friction sheets 28 and 28S, the nip formation pads 24 and 24S, and the fixing belt 21, the rotation speed of the fixing belt 21, pressure exerted to the fixing nip N, and the like. The basic construction of the fixing devices 20 and 20S may be modified properly.

Further, the construction of the image forming apparatus 1 may be modified arbitrarily. For example, the image forming apparatus 1 uses toners in four colors. Alternatively, the image forming apparatus 1 may be a full color image forming apparatus using toners in three colors, a multicolor image forming apparatus using toners in two colors, or a monochrome image forming apparatus using toner in a single color.

According to the exemplary embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator that is endless and rotatable in a rotation direction;

a heater to heat the fixing rotator;

a pressure rotator to contact an outer circumferential surface of the fixing rotator;

a nip formation pad to press against the pressure rotator via the fixing rotator to form a fixing nip between the fixing rotator and the pressure rotator, the nip formation pad including an upstream portion disposed upstream from the fixing nip in the rotation direction of the fixing rotator;

a plurality of recesses disposed in the upstream portion of the nip formation pad, the plurality of recesses being disposed on one line which is parallel to an axial direction of the fixing rotator; and a friction reducer being sandwiched between the nip formation pad and the fixing rotator and bearing a lubricant.

2. The fixing device according to claim 1, wherein the friction reducer is applied with the lubricant.

3. The fixing device according to claim 1, wherein the friction reducer is impregnated with the lubricant.

4. The fixing device according to claim 1, wherein the nip formation pad further includes an upstream end in the rotation direction of the fixing rotator.

5. The fixing device according to claim 4, wherein the plurality of recesses adjoin the upstream end of the nip formation pad.

6. The fixing device according to claim 4, wherein the plurality of recesses are disposed in proximity to the upstream end of the nip formation pad.

7. The fixing device according to claim 1, wherein the nip formation pad further includes a nip forming portion disposed opposite the fixing nip, and wherein the upstream portion is disposed upstream from the nip forming portion in the rotation direction of the fixing rotator.

8. The fixing device according to claim 1, wherein the upstream portion of the nip formation pad includes a nip-side face that is other than the plurality of recesses, the nip-side face to press against the fixing rotator via the friction reducer.

9. The fixing device according to claim 1, wherein the plurality of recesses project beyond the friction reducer in a direction opposite the rotation direction of the fixing rotator.

10. The fixing device according to claim 1, wherein the nip formation pad is made of one of resin, metal, and copper.

11. The fixing device according to claim 1, wherein each of the plurality of recesses includes a corresponding groove.

12. The fixing device according to claim 1, wherein the friction reducer includes a sheet and the fixing rotator includes an endless belt.

13. The fixing device according to claim 1, wherein:

the plurality of recesses are on a surface of the nip formation pad that is perpendicular to a surface of the nip formation pad that presses against the pressure rotator via the fixing rotator.

14. The fixing device according to claim 1, wherein:

the plurality of recesses are in a surface of the nip formation pad that presses against the pressure rotator via the fixing rotator.

15. A fixing device comprising:

a fixing rotator that is endless and rotatable in a rotation direction;

a heater to heat the fixing rotator;

a pressure rotator to contact an outer circumferential surface of the fixing rotator;

a nip formation pad to press against the pressure rotator via the fixing rotator to form a fixing nip between the fixing rotator and the pressure rotator, the nip formation pad including:

a nip forming portion disposed opposite the fixing nip; and an upstream portion disposed upstream from the nip forming portion in the rotation direction of the fixing rotator, the upstream portion including a recess disposed substantially at a center of the nip formation pad in a longitudinal direction of the nip formation pad, the recess being recessed toward the nip forming portion in the rotation direction of the fixing rotator; and a friction reducer being sandwiched between the nip formation pad and the fixing rotator and bearing a lubricant, wherein the upstream portion further includes one of a linear slope defined by the recess and a curve defined by the recesses, the one of a linear slope defined by the recess and a curve defined by the recesses increasing a length of the nip formation pad in the rotation direction of the fixing rotator from the center to a lateral edge of the nip formation pad in the longitudinal direction of the nip formation pad.

16. The fixing device according to claim 15, wherein the one of a linear slope defined by the recess and a curve defined by the recesses includes the linear slope defined by the recess.

17. The fixing device according to claim 15, wherein the one of a linear slope defined by the recess and a curve defined by the recesses includes the curve defined by the recess.

18. A fixing device comprising:

a fixing rotator that is endless and rotatable in a rotation direction;

a heater to heat the fixing rotator;

a pressure rotator to contact an outer circumferential surface of the fixing rotator;

a nip formation pad to press against the pressure rotator via the fixing rotator to form a fixing nip between the fixing rotator and the pressure rotator, the nip formation pad including an upstream portion disposed upstream from the fixing nip in the rotation direction of the fixing rotator;

a recess disposed in the upstream portion of the nip formation pad; and a friction reducer being sandwiched between the nip formation pad and the fixing rotator and bearing a lubricant, wherein the recess projects beyond the friction reducer in a direction opposite the rotation direction of the fixing rotator.

* * * * *